United States Patent [19]

Sikora

[11] Patent Number: 4,900,990

[45] Date of Patent: Feb. 13, 1990

[54] METHOD AND APPARATUS FOR ENERGIZING A GASEOUS DISCHARGE LAMP USING SWITCHED ENERGY STORAGE CAPACITORS

[76] Inventor: Scott T. Sikora, 2420 S. Eldorado, Mesa, Ariz. 85254

[21] Appl. No.: 105,714

[22] Filed: Oct. 6, 1987

[51] Int. Cl.[4] ..... H05B 41/14

[52] U.S. Cl. ..... 315/241 P; 354/145.1

[58] Field of Search ..... 315/241 P, 241 S, 242; 354/145.1, 135

[56] References Cited

U.S. PATENT DOCUMENTS

| | | | |
|---|---|---|---|
| 2,922,079 | 1/1960 | Borchers et al. | 315/234 |
| 3,376,470 | 4/1968 | Stone et al. | 315/171 |
| 4,486,691 | 12/1984 | Beggs | 315/241 |
| 4,672,273 | 6/1987 | Ikawa et al. | 315/241 P |
| 4,682,081 | 7/1987 | Sikora | 315/219 |
| 4,684,852 | 8/1987 | Balogh | 315/241 |

*Primary Examiner*—Benedict V. Safourek
*Assistant Examiner*—T. Salindong

[57] ABSTRACT

A trigger circuit is coupled to a gas discharge lamp having anode and cathode terminals, a minimum anode voltage and a minimum holding voltage. The trigger circuit periodically transmits a trigger voltage pulse to the lamp to provide first stage ionization of the gas in the lamp. A power supply circuit charges a boost storage capacitor to a first voltage and an energy storage capacitor to a second voltage above the minimum holding but below the minimum anode voltage. The sum of the first and second voltages exceeds the lamp minimum anode voltage. A voltage controlled capacitor switching circuit includes input terminals coupled across the boost storage capacitor and across the energy storage capacitor and output terminals coupled to the anode and cathode terminals of the lamp. This switching circuit operates in a first state to apply a boost voltage exceeding the minimum anode voltage across the lamp anode and cathode terminals to allow energy to flow into the lamp after the first stage ionization of the lamp by the trigger circuit to provide second stage ionization of the lamp. The capacitor switching circuit switches into a second state after the boost voltage falls below the minimum anode voltage but before it falls below the minimum holding voltage to couple the energy storage capacitor across the lamp anode and cathode terminals to enable the energy storage capacitor to discharge additional energy into the lamp.

57 Claims, 9 Drawing Sheets

METHOD AND APPARATUS FOR ENERGIZING A GASEOUS DISCHARGE LAMP USING SWITCHED ENERGY STORAGE CAPACITORS

BACKGROUND OF THE INVENTION

1. Field of the Invention

The present invention relates to power supplies for gaseous discharge lamps, and more particularly, to power supplies using at least two switched energy storage capacitors.

2. Description of the Prior Art

As illustrated in FIG. 1, prior art gaseous discharge lamp power supplies generally include a power supply which charges an energy storage capacitor to a comparatively high voltage, for example about 400 volts. Upon completion of the energy storage capacitor charging cycle, a trigger circuit generates a trigger voltage pulse having a narrow pulse width, but with a very high voltage, for example six thousand volts. The application of the trigger voltage to the lamp provides first stage ionization of the gas in the lamp and significantly lowers the internal impedance of the lamp from a nearly infinite value to a substantially lower value. The trigger voltage induced lamp impedance reduction enables the four hundred volt energy storage capacitor voltage to pass a current through the lamp which accomplishes second stage ionization of the lamp, further reducing the internal lamp impedance to a level on the order of one to two Ohms.

To achieve second stage ionization, the energy storage capacitor voltage must exceed a predetermined threshold voltage known as the minimum anode voltage at the time the trigger pulse is applied. As illustrated by FIG. 2, the magnitude of the minimum anode voltage is inversely proportional to the trigger voltage. As the trigger voltage increases, the minimum anode voltage decreases.

In FIG. 2, reference number 1 designates a hypothetical trigger voltage applied to the lamp to induce first stage ionization. Reference number 2 represents a specific energy storage capacitor voltage exceeding the lamp minimum anode voltage which will induce second stage ionization. If the energy storage capacitor voltage did not exceed the minimum anode voltage, second stage ionization of the lamp would not occur and the lamp would not generate useful output.

As the energy storage capacitor discharges current through the lamp, its voltage decreases below the minimum anode voltage, but the current flow through the lamp and its low impedance are maintained until the energy storage capacitor voltage decreases to the minimum holding voltage designated in FIG. 2 by reference number 3. Typical lamp minimum holding voltages vary about thirty to fifty volts. When the energy storage capacitor voltage falls below the minimum holding voltage, the gaseous interior of the lamp deionizes, the internal impedance of the lamp returns to its near infinite deionized state impedance and the output from the lamp terminates.

The cycle described above is repeated after the power supply recharges the energy storage capacitor to the desired peak capacitor voltage in excess of the lamp minimum anode voltage. A subsequent trigger pulse induces first stage ionization which reduces the internal impedance of the lamp and enables the fully charged energy storage capacitor to initiate second stage ionization.

In many applications, the gas discharge lamp depicted in FIG. 1 operates as a strobe light warning device for police car, fire engine, ambulance, aircraft and related optical signalling applications. In such applications, aluminum electrolytic capacitors are universally used as energy storage capacitors due to their low cost and extremely high power storage density. Electrolysis capacitors inherently possess a high equivalent series resistance ("ESR") which, due to the high output current levels required in strobe light applications, results in a significant $I^2R$ capacitor power dissipation causing electrolytic capacitors used in strobe power supplies to operate at temperature approaching their design limits.

When operated at or near its temperature limit in a gaseous discharge circuit, the mean time before failure (MTBF) of an aluminum electrolytic capacitor is reduced to from about one hundred to one thousand hours, an extremely short operating lifetime for a manufacturer who may have to guarantee a strobe power supply for one year or for a user who desires a useful operating life of many years.

Although continuous operation does not represent a standard operating mode for a police or fire truck application, a strobe power supply intended for such applications was operated continuously until failure to evaluate the MTBF of a typical prior art strobe power supply circuit with its energy storage capacitor operating at peak temperature. In this particular test, the energy storage capacitor failed after three days or approximately seventy-two hours of continuous operation.

It is well known that the MTBF of an aluminum electrolytic capacitor decreases exponentially with increases in its operating temperature. For example, when operated at a comparatively low twenty-seven degree Centigrade temperature, an aluminum electrolytic capacitor may be expected to have an MTBF of tens of thousands of hours. When compared to the anticipated MTBF of one hundred to one thousand hours for a capacitor operating at its eighty-five degree Centigrade operating limit, the magnitude of the problem caused by the electrolytic energy storage capacitors becomes immediately apparent.

Although other types of capacitors such as metal film capacitors possess extremely low ESR ratings for the large capacitance values required in strobe power supplies, an equivalent metal film capacitor would be about four times larger than a comparable aluminum electrolytic capacitor and cost from four to ten times more. Utilizing low ESR energy storage capacitors such as metal film capacitors in strobe power supplies is therefore commercially impractical due to their large size and high cost.

Although the operating temperature of strobe power supply energy storage capacitors could be reduced by utilizing well designed heat sinks, the extra cost and volume requirements of heat sinks outweigh their potential benefits.

Strobe power supplies which generate a double flash output consisting of closely spaced primary and secondary flashes followed by a comparatively long time interval until the next double flash are currently very popular. In aircraft and vehicular applications, a double flash output is desirable because it is even more easily seen than a single strobe flash.

To generate the primary flash component of a double flash output, an energy storage capacitor must first be charged to a voltage higher than the strobe lamp minimum anode voltage and then be discharged through the lamp following application of the trigger voltage. Discharge of the energy storage capacitor during the primary flash reduces its voltage well below the minimum anode voltage. During the one tenth of a second time interval between the primary and secondary flashes, the power supply must recharge the energy storage capacitor to a voltage above the minimum anode voltage. In the energy storage capacitor voltage cannot be increased to a level above the minimum anode voltage during that one tenth of a second interval, the energy storage capacitor will not be able to produce the necessary second stage ionization in response to the second trigger voltage pulse and the secondary flash of the double flash group will not occur.

Prior art double flash strobe power supplies have solved this energy storage capacitor charging problem by reducing the capacitance of the energy storage capacitor and by increasing the rate that the capacitor charging voltage is applied from about four hundred volts per second to six hundred volts per second. These two changes enable the energy storage capacitor to be recharged to a voltage above the lamp minimum anode voltage during the one tenth of a second interval between the primary and secondary flashes of a double flash group.

Since the ESR of aluminum electrolytic capacitors increases as the capacitors rating decreases, the ESR of the lower capacitance energy storage capacitors used in double flash strobe power supplies is even higher than the already high ESR of capacitors used in single flash strobe power supplies. The higher voltage rating required for double flash energy storage capacitors increases the volumetric size and cost of these capacitors while the higher ESR ratings of these capacitors results in even higher capacitor operating temperatures. All of these factors taken together cause double flash strobe power supplies to be larger, less efficient and less reliable than comparable single flash strobe power supplies.

SUMMARY OF THE INVENTION

It is therefore a primary object of the present invention to provide a method and apparatus for energizing a gaseous discharge lamp using switched energy storage capacitors which utilizes a low ESR, non-electrolytic boost storage capacitor to induce second stage ionization of the lamp and a comparatively low ESR electrolytic energy storage capacitor to discharge substantial energy through the lamp after its internal impedance has been reduced to a low level by the boost storage capacitor.

Another object of the present invention is to provide a method and apparatus for energizing a gaseous discharge lamp using switched energy storage capacitors where at the end of the capacitor charging cycle the voltage on the boost storage capacitor either alone or in combination with the voltage on the energy storage capacitor exceeds the lamp minimum anode voltage, but where the voltage on the energy storage capacitor by itself is less than the lamp minimum anode voltage.

Another object of the present invention is to provide a method and apparatus for energizing a gaseous discharge lamp using switching energy storage capacitors where use of low ESR energy storage capacitor results in capacitor operating temperatures well below the maximum rated operating temperature to substantially prolong the MTBF of such capacitors.

Another object of the present invention is to provide a method and apparatus for energizing a gaseous discharge lamp using switched energy storage capacitors including a boost storage capacitor and an energy storage capacitor which can be readily recharged during the short time interval between the primary and secondary flashes of a double flash group without utilizing elevated power supply output voltages, reduced capacitance or increased voltage ratings for the energy storage capacitor.

Another object of the present invention is to provide a method and apparatus for energizing a gaseous discharge lamp using switched energy storage capacitors including a boost storage capacitor which is charged to a voltage in excess of the lamp minimum anode voltage and an energy storage capacitor which is charged to a voltage above the lamp minimum holding voltage but below the lamp minimum anode voltage.

Another object of the present invention is to provide a method and apparatus for energizing a gaseous discharge lamp using switched energy storage capacitors to produce a substantially longer flash duration than prior art systems using only a single energy storage capacitor.

Briefly stated, and in accord with one embodiment of the invention, the present invention comprises an apparatus for flashing a gas discharge lamp having a gas interior, and anode and cathode terminals, a minimum anode voltage and a minimum holding voltage. Trigger means is coupled to the lamp to generate a trigger pulse to provide first stage ionization of the gas in the lamp. The present invention also includes capacitor means having a boost capacitor and an energy storage capacitor. Power supply means is coupled to the capacitor means to charge the boost storage capacitor to a first voltage above the minimum holding voltage and for charging the energy storage capacitor to a second voltage above the minimum holding voltage but below the minimum anode voltage. The sum of the first and second voltages must exceed the minimum abode voltage of the lamp. Voltage controlled capacitor switching means includes input terminals coupled across the boost storage capacitor and across the energy storage capacitor as well as output terminals coupled to the anode and cathode terminals of the lamp. The capacitor switching means operates in a first state to apply a voltage exceeding the minimum anode voltage across the anode and cathode terminals of the lamp to allow energy to flow into the lamp upon the first stage ionization of the gas in the lamp by the trigger means to provide second stage ionization of the gas in the lamp. The capacitor switching means then switches into a second state after the voltage applied to the lamp falls below the minimum anode voltage but before the voltage falls below the minimum holding voltage to couple the energy storage capacitor across the anode and cathode terminals of the lamp to enable said energy storage capacitor to discharge additional energy into the lamp.

DESCRIPTION OF THE DRAWINGS

The invention is pointed out with particularly in the appended claims. However, other objects and advantages together with the operation of the invention may be better understood by reference to the following detailed description in conjunction with the following illustrates, wherein:

DETAILED DESCRIPTION OF THE INVENTION

In order to better illustrate the advantages of the invention and its contributions to the art, a number of preferred embodiments of the invention will now be reviewed in detail.

Figure 3:
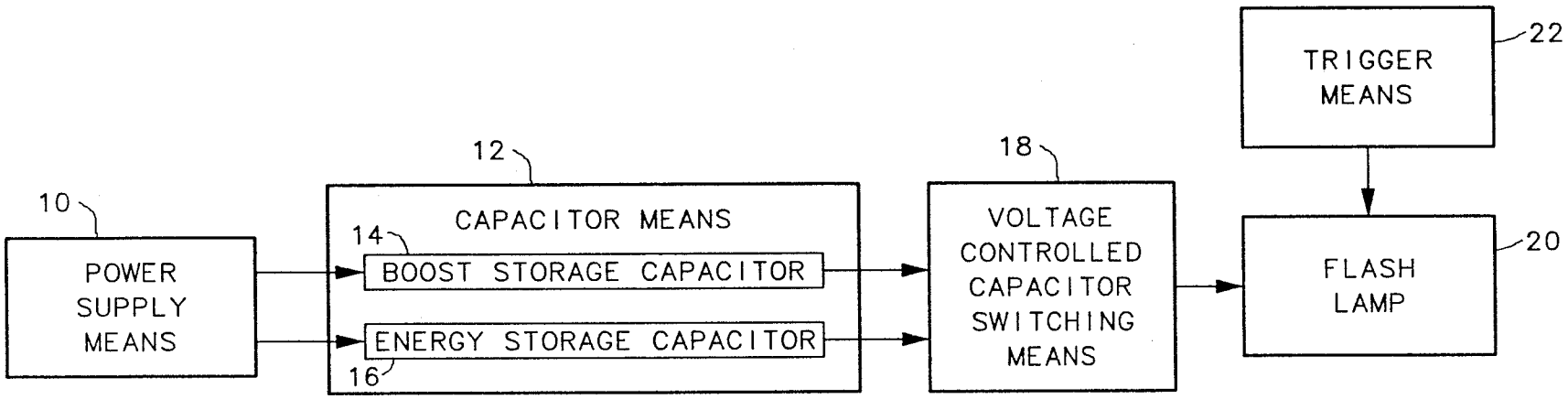
FIG. 3 is a block diagram representation which broadly illustrates the elements of the present invention.
Figure 4:
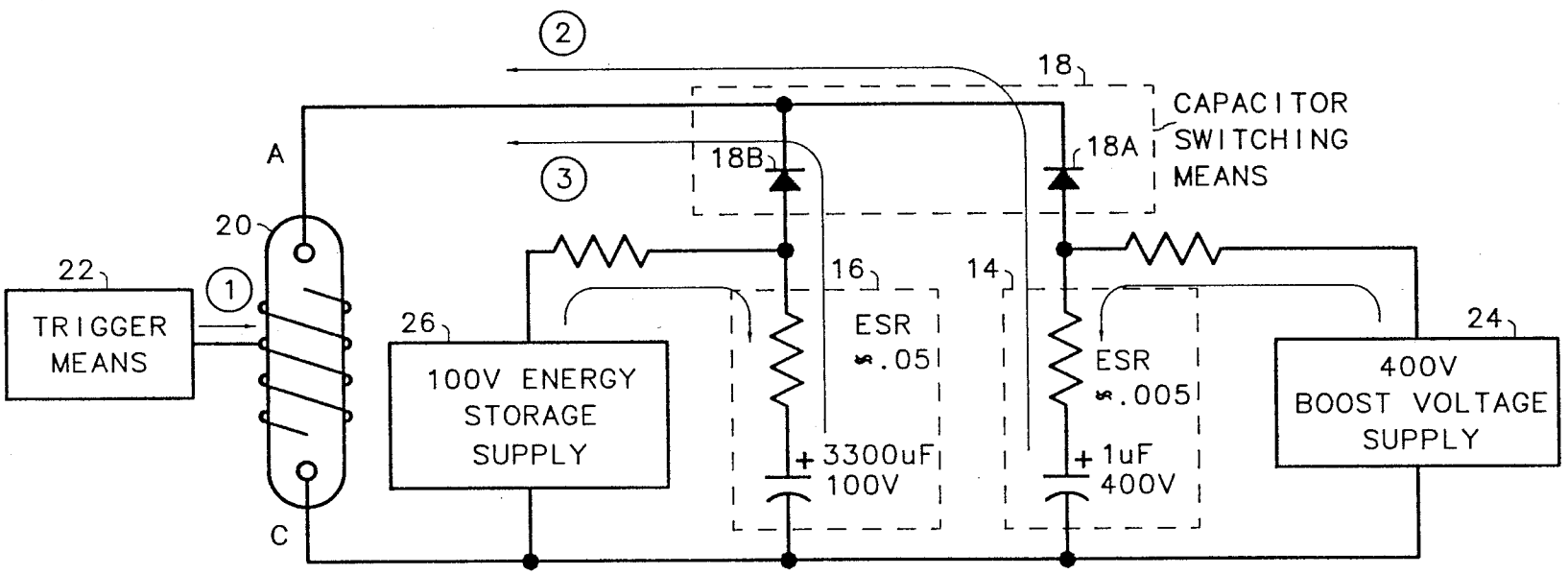
FIG. 4 is an electrical schematic diagram of a preferred embodiment of the present invention.
Figure 5:
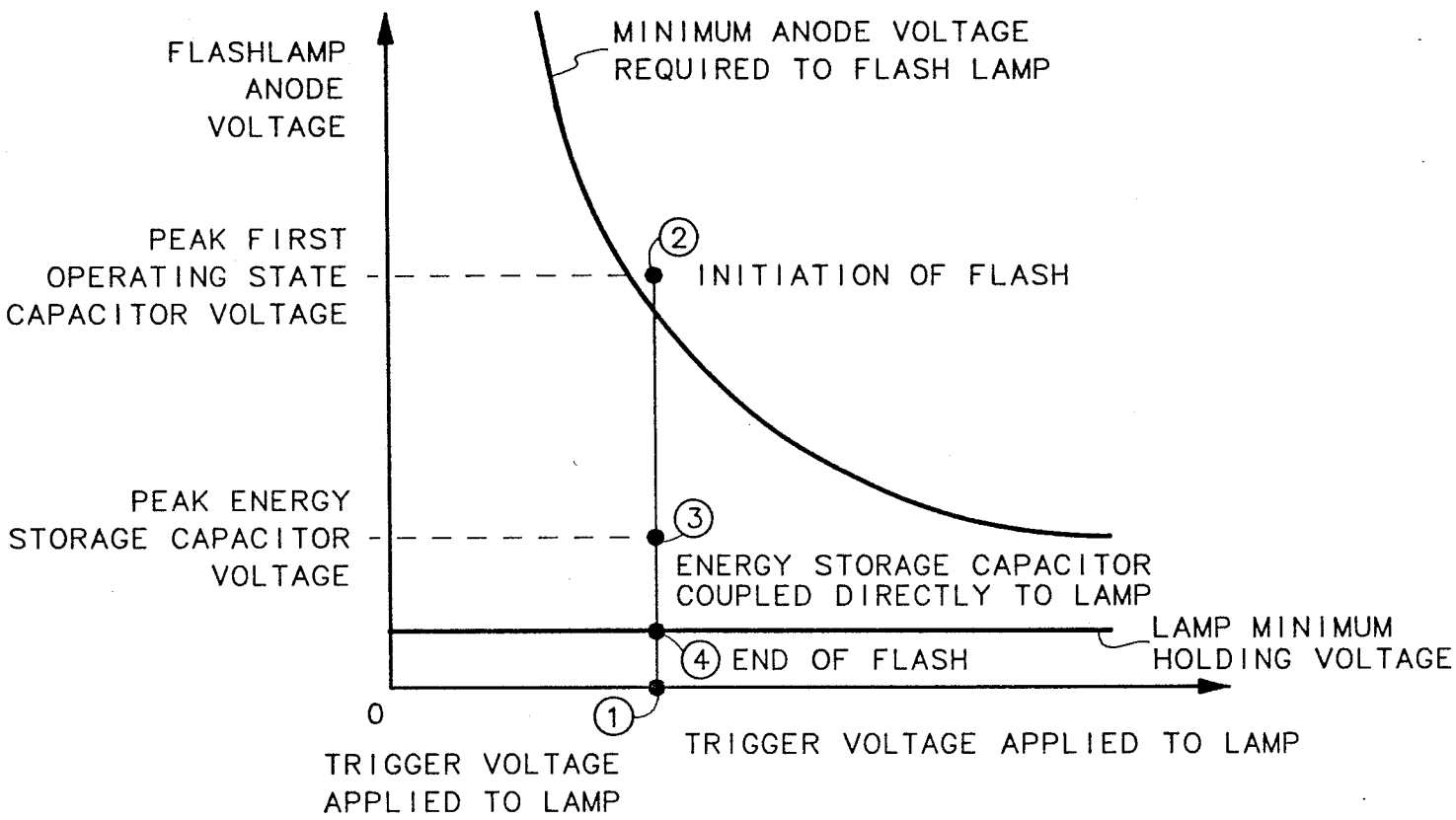
FIG. 5 is a graph illustrating the interrelationship between the operation of the present invention and the operating characteristics of a gas discharge tube.

Referring now to FIGS. 3, 4 and 5, the strobe power supply of the present invention includes power supply means 10 and capacitor means 12 including a boost capacitor 14 and an energy storage capacitor 16 which are independently charged by power supply means 10.

The voltages on boost storage capacitor 14 and on energy storage capacitor 16 are separately coupled to voltage controlled capacitor switching means 18 which sequentially interconnects capacitors 14 and 16 in a variety of configurations to apply appropriate voltages to operate flash lamp 20. Trigger means 22 represents a conventional flash lamp trigger circuit which may be configured to operate in a variety of different modes well known to one of ordinary skill in the art.

FIG. 4 illustrates an electrical schematic diagram of one specific embodiment of the invention where power supply means 10 is divided into a boost voltage supply 24 having a four hundred volt output and into an energy storage supply 26 having a one hundred volt output.

The output of boost voltage supply 24 is coupled across boost storage capacitor 14 which takes the form of a low ESR one microfarad, four hundred volt capacitor. A one microfarad metal foil capacitor having an ESR rating on the order of 0.005 ohms functions well in this circuit.

The output of energy storage supply 26 is coupled across energy storage capacitor 16 which may take the form of a thirty-three hundred microfarad, one hundred volt aluminum electrolytic capacitor having an ESR rating on the order of 0.05 Ohms. During the strobe power supply charging cycle, boost storage capacitor 14 is charged to four hundred volts while energy storage capacitor 16 is charged to one hundred volts.

The output of capacitors 14 and 16 are coupled to the input terminals of capacitor switching means 18 which in the FIG. 4 embodiment of the invention takes the form of switching diodes 18A and 18B. The output of capacitor switching means 18 is coupled across the anode and cathode terminals of flash lamp 20.

Referring now to FIGS. 4 and 5, trigger means 22 applies a trigger voltage pulse designated by reference number 1 to flash lamp 20 resulting in the first stage ionization of lamp 20. In FIGS. 4 and 5, corresponding reference numbers designating the various current flow paths in the strobe power supply have been used for continuity.

The first stage ionization of lamp 20 by trigger pulse 1 substantially reduces the internal impedance of lamp 20. Forward biased switching diode 18A enables the four hundred volt output of boost storage capacitor 14 to be imposed directly across the anode and cathode terminals of lamp 20 while reverse biased switching diode 18B decouples energy storage capacitor 16 from lamp 20.

As illustrated in FIG. 5, because the four hundred volt boost storage capacitor voltage 2 exceeds the minimum anode voltage of lamp 20 (typically between two hundred and fifty and three hundred and fifty volts), it causes a current to flow through the gaseous interior of lamp 20 and induces second stage ionization of the lamp which substantially reduces the internal impedance of lamp 20 to a normal level on the order of one to two Ohms.

The second stage ionization of lamp 20 caused by the discharge of boost storage capacitor 14 through lamp 20 enables energy storage capacitor 16 to begin discharging its substantial stored energy through switching diode 18B and through lamp 20 as the voltage on boost storage capacitor 14 drops below the voltage level of the energy storage capacitor 16. As this capacitor voltage transition occurs, switching diode 18B transitions from a reverse biased to a forward biased condition. In FIG. 5, this transition of switching means 18 from boost storage capacitor 14 to parallel-connected boost storage capacitor 14 and energy storage capacitor 16 is designated by reference number 3. Energy storage capacitor 16 and boost storage capacitor 14 will continue discharging current through lamp 20 until their voltage drops below the minimum holding voltage of lamp 20 (typically thirty to fifty volts), designated in FIG. 5 by reference number 4.

Figure 1:
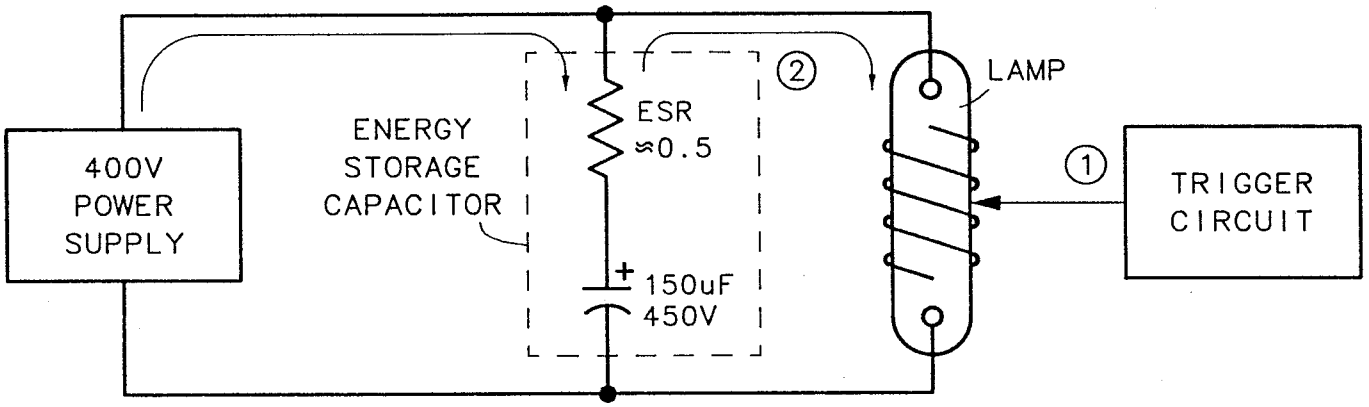
PRIOR ART FIG. 1
FIG. 1 is a block diagram of a typical prior art strobe flash power supply.
Figure 2:
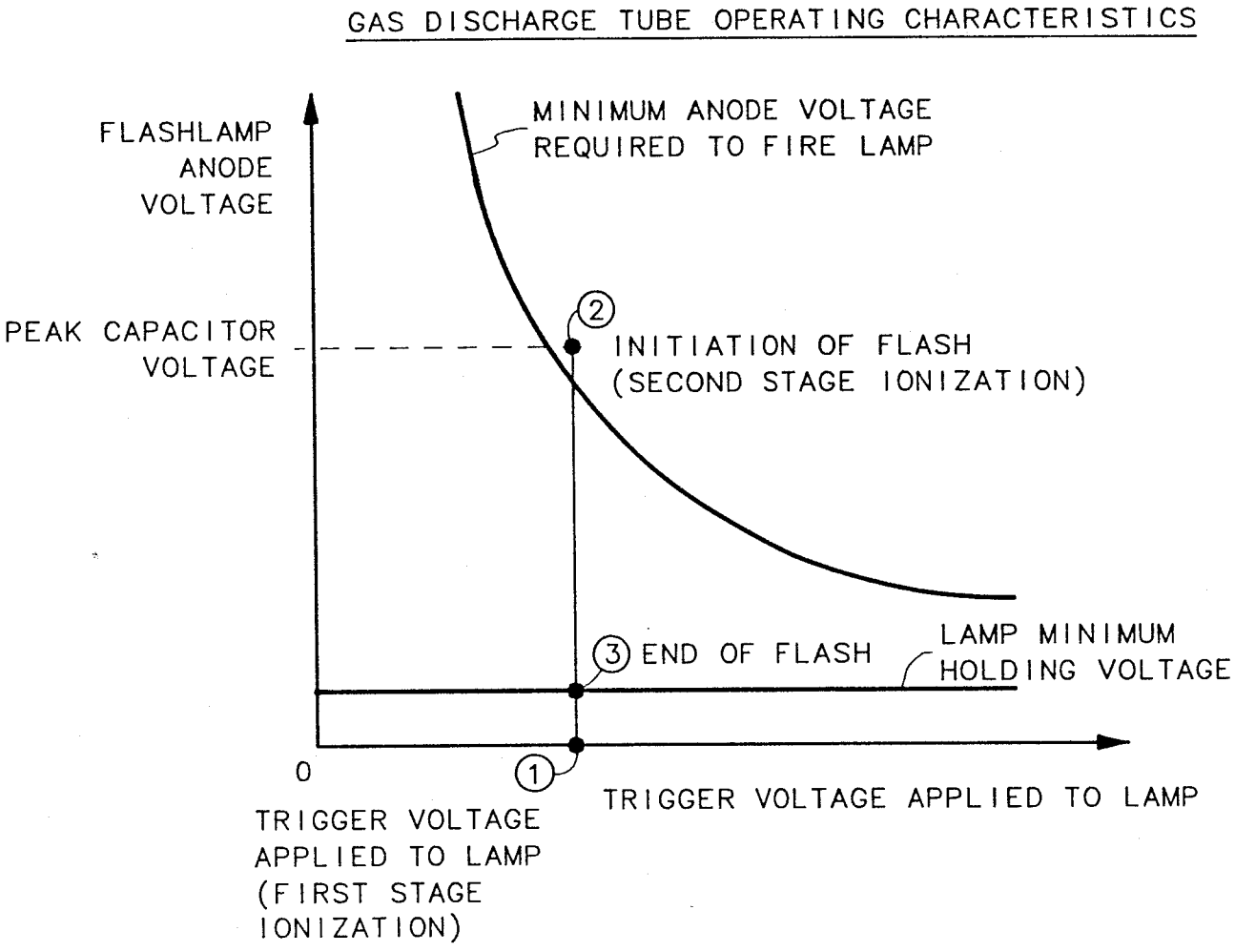
FIG. 2 is a graph illustrating gas discharge tube operating characteristics.
Figure 6A:
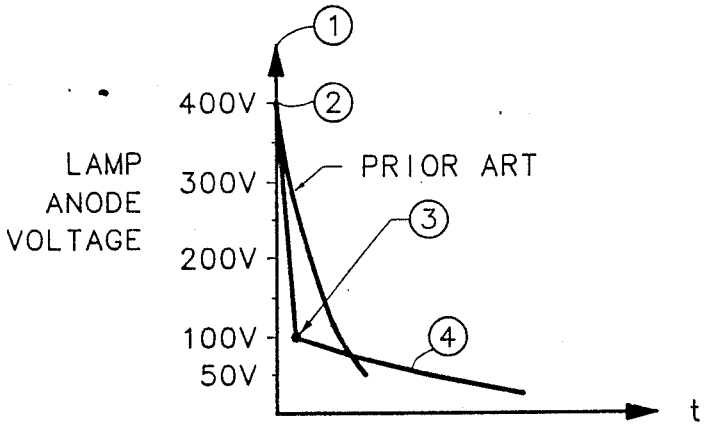
FIGS. 6A and 6B graphically depict plots of lamp anode voltage and lamp current versus time for both the prior art power supply illustrated in FIG. 1 and for the present invention.
Figure 6B:
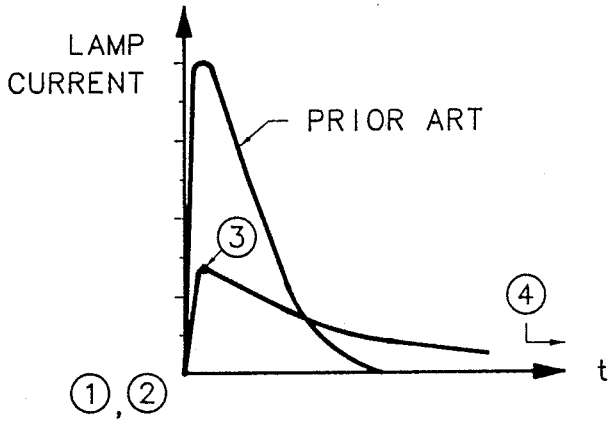

Referring now also to FIGS. 6A and 6B, the lamp voltage and current plots of the FIG. 4 embodiment of the invention may be compared to comparable characteristics of the prior art FIG. 1 strobe power supply. FIG. 6A illustrates that trigger voltage 1 results in first stage ionization of lamp 20 and that the application of the four hundred volt boost storage capacitor voltage 2 produces a rapidly decreasing voltage across lamp 20 and a rapidly increasing current through lamp 20 as the impedance of lamp 20 continues to fall. As the voltage on boost storage capacitor 14 drops to a value equal to the capacitor on energy storage capacitor 16, capacitor switching means 18 connects energy storage capacitor 16 across lamp 20. Energy storage capacitor 16 directs a slowly decreasing current with a slowly decreasing voltage through lamp 20 as indicated by the line segment interconnecting reference numbers 3 and 4. In FIGS. 6A and 6B, the smoothly deceasing lamp current and voltage traces produced by the single energy storage capacitor prior art strobe power supply are depicted to illustrate the significant differences between the output of the prior art system and the output of the switched capacitor strobe power supply of the present invention. FIG. 6 clearly illustrates that the present invention produces a substantially longer flash lamp optical pulse width than the prior art system since the lamp minimum holding voltage is reached later than with prior art systems.

Although the flash lamps used in the FIG. 1 and FIG. 4 circuits are identical and the amount of energy transferred through the flash lamps by these circuits is also identical, the ESR of the FIG. 4 energy storage capacitor is only about one tenth as large as the ESR of the FIG. 1 energy storage capacitor. The volumetric size of the thirty-three hundred microfarad/one hundred volt electrolytic capacitor used in the FIG. 4 circuit is approximately equal to the size of the one hundred and fifty microfarad/four hundred and fifty volt capacitor used in the prior art FIG. 1 circuit. The FIG. 4 one hundred volt capacitor costs approximately the same as the four hundred and fifty volt capacitor used in the FIG. 1 power supply. The efficiency of the FIG. 4 power supply is substantially higher than the efficiency of the FIG. 1 power supply as a direct result of a large reduction in the amount of electrical energy converted into heat energy by the ten times lower ESR of the FIG. 4 energy storage capacitor in comparison to the FIG. 1 prior art power supply. In continuous operation, the FIG. 1 energy storage capacitor operates close to its eighty-five degree Centigrade operating limit (a fifty degree Centigrade rise over ambient), while the FIG. 4 energy storage capacitor operates at a temperature only about ten degrees Centigrade above ambient temperature. Since the one microfarad/four hundred volt metal film capacitor used as the FIG. 4 boost storage capacitor occupies a cylindrical volume approximately one inch in length and one half inch in diameter and costs about twenty-one cents, the addition of this low ESR, low operating temperature capacitor to the FIG. 4 power supply can be accomplished without adverse consequences.

The FIG. 4 circuit may be easily adapted to produce a double flash output by merely reconfiguring trigger means 22 to generate paired primary and secondary trigger pulses to initiate the desired double flash output of the strobe power supply. As illustrated in FIG. 6A and 6B, the optical output from strobe lamp 20 terminates when the voltage on energy storage capacitor 16 drops to the forty volt minimum holding voltage of strobe lamp 20. Because of its one microfarad rating, boost storage capacitor 14 will quickly be recharged to a four hundred volt level well within the desired one tenth second spacing between the primary and secondary outputs of strobe lamp 20. During this same short time interval, energy storage capacitor 16 will be recharged to a level well in excess of the forty volt lamp minimum holding voltage, but less than the one hundred volt output of energy storage supply 26.

In response to the secondary trigger pulse, boost storage capacitor 14 will produce second stage ionization of the lamp, enabling energy storage capacitor 16 to discharge energy through lamp 20 until the capacitor voltage drops below the lamp minimum holding voltage. Because the energy storage capacitor may not be recharged fully during the short time interval between the primary and secondary lamp pulses, the secondary lamp flash intensity may be somewhat less than the primary lamp flash intensity.

A double flash version of the FIG. 4 strobe power supply using a one microfarad/four hundred volt metal film boost storage capacitor and an eight hundred and twenty microfarad/two hundred volt electrolytic energy storage capacitor has been operating continuously for about four thousand hours. Although the flash lamp energized by this test power supply has required replacement several times, the electrolytic energy storage capacitor has operated without failure at a temperature about ten degrees Centigrade above ambient. This contrasts sharply with a prior art strobe power supply having a single one hundred and fifty microfarad/four hundred and fifty volt electrolytic energy storage capacitor which failed after seventy-two hours of continuous operation.

Figure 7:
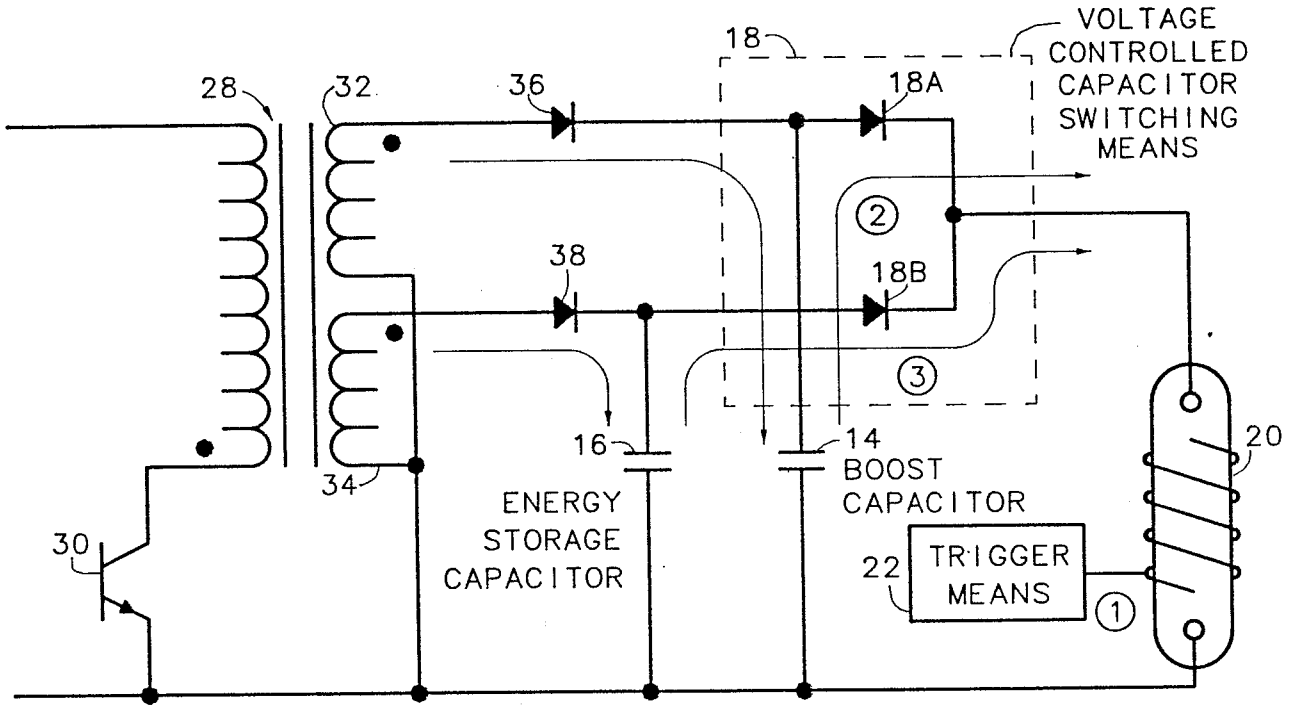
FIG. 7 illustrates another preferred embodiment of the present invention.

Referring now to FIG. 7, another embodiment of the invention is depicted which is closely related to the FIG. 4 embodiment. In the FIG. 7 embodiment, the power supply means of the invention takes the form of a switched DC to DC power supply including a coupled inductor 28 and a switching transistor 30. Coupled inductor 28 includes a first secondary winding 32 and a second secondary winding 34. First winding 32 includes twice the number of windings as does first winding 34 to charge boost storage capacitor 14 to four hundred volts and energy storage capacitor 16 to two hundred volts.

Diodes 36 and 38 serve as half wave rectifiers for rectifying the pulsed positive and negative output pulses generated by windings 32 and 34 into separate charging currents for boost storage capacitor 14 and energy storage capacitor 16. Other than these differences, the FIG. 7 circuit functions identically to the FIG. 4 circuit.

Figure 8:
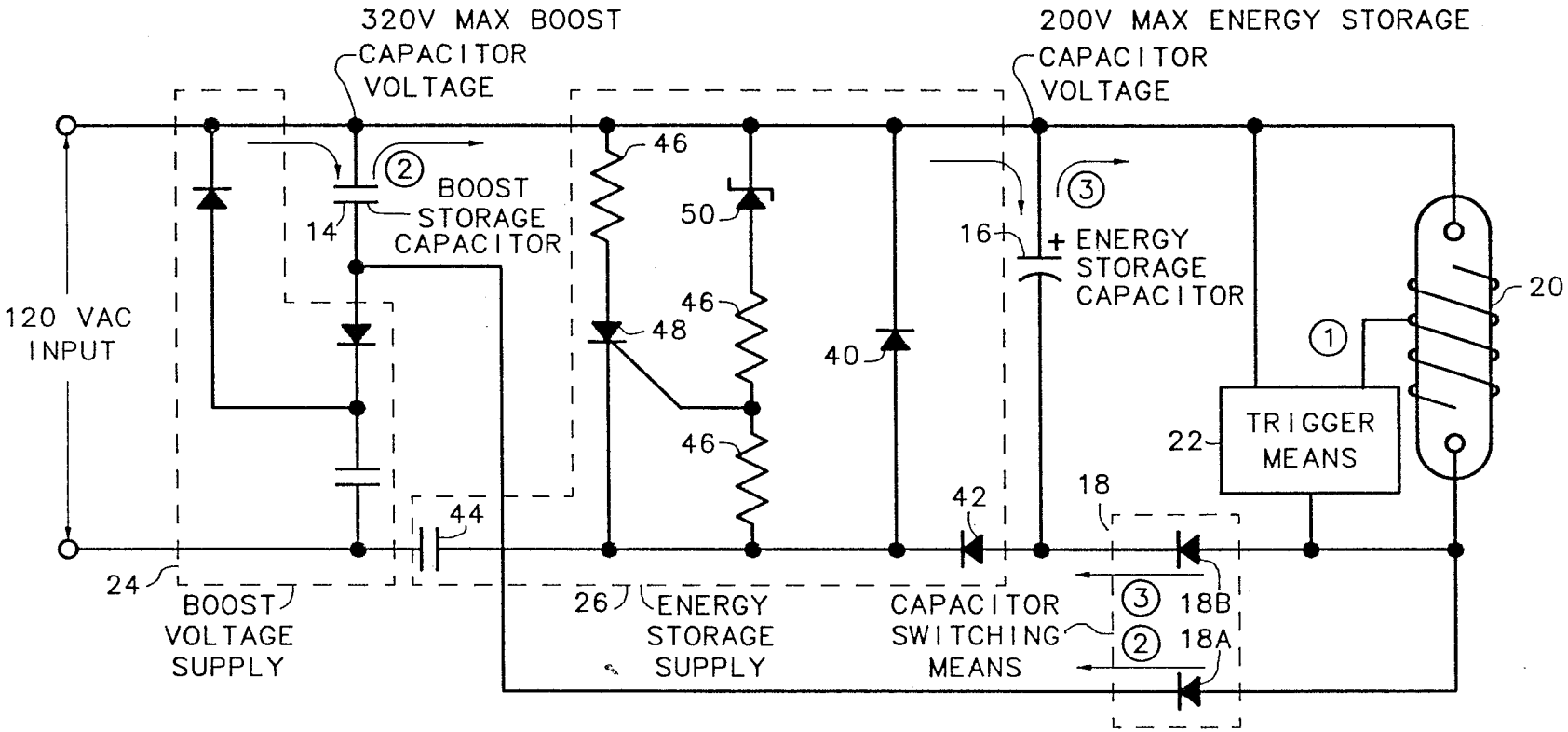
FIG. 8 illustrates yet another preferred embodiment of the present invention utilizing an AC power source.

Another method of implementing the present invention to use an alternating current electrical input is depicted in FIG. 8. In this embodiment of the invention, boost voltage supply 24 takes the form of a standard voltage doubler circuit which converts a one hundred and ten volt AC RMS input (one hundred and sixty volts peak to peak) into a three hundred and twenty volt pulsed DC output for charging boost storage capacitor 14 to three hundred and twenty volts. Lamp 20 is selected to have a minimum anode voltage on the order of two hundred and fifty to three hundred volts.

The one hundred and twenty volt AC input is also coupled to energy storage supply 26 which includes an essentially identical voltage doubler circuit including diodes 40 and 42 and charging capacitor 44. A voltage regulator circuit consisting of resistors 46, SCR 48 and zener diode 50 limit the voltage applied to energy storage capacitor 16 to two hundred volts.

Voltage controlled capacitor switching means 18 includes switching diodes 18A and 18B which function identically to the switching diodes previously described in connection with the FIG. 4 embodiment of the invention.

Before trigger means 22 generates a trigger voltage pulse 1 to provide first stage ionization of lamp 20, capacitor switching means 18 applies three hundred and twenty volts from boost storage capacitor 14 across the anode and cathode terminals of lamp 20. Application of trigger pulse 1 to lamp 20 produces first stage ionization of lamp 20. Subsequent current flow from boost storage capacitor 14 produces second stage ionization of lamp 20. As soon as the voltage on boost storage capacitor 14 drops below the voltage on energy storage capacitor 16, switching diode 18B becomes forward biased, permitting energy storage capacitor 16 to discharge through lamp 20 until its voltage drops below the minimum holding voltage.

The FIG. 8 circuit represents an AC implementation of the present invention which is small, inexpensive, highly efficient and highly reliable. The extremely low temperature rise experienced by the low voltage rating/low ESR energy storage capacitor 16 results in a minimum of thermal stress being applied to that device, yielding an extremely reliable circuit which can be operated continuously for thousands of hours and potentially years without failure of the aluminum electrolytic energy storage capacitor.

Yet another embodiment of the present invention will now be described by reference to FIG. 9. The DC to DC switching power supply including coupled inductor 28 having first and second secondary windings 32 and 34 and switching transistor 30 is a conventional design of the type described in connection with FIG. 7 above except that windings 32 and 34 will have the same number of winding. The structure and operation of a comparable strobe power supply is described in U.S. Pat. No. 4,682,081 issued on July 21, 1987 to Scott Sikora. The disclosure of that patent is hereby incorporated by reference.

The output of first winding 32 is coupled across a one microfarad/two hundred volt metal film boost storage capacitor 14 while the output of second winding 34 is coupled across an eight hundred and twenty microfarad/two hundred volt aluminum electrolytic energy storage capacitor 16. In this embodiment of the invention, boost storage capacitor 14 is coupled in series with energy storage capacitor 16. A diode 18 is coupled in parallel with boost storage capacitor 14 and in series with energy storage capacitor 16 and serves as the voltage controlled capacitor switching means 18 of the present invention. The minimum anode voltage of lamp 20 should reside between two hundred and fifty to four hundred volts.

During the capacitor charging cycle, boost storage capacitor 14 and energy storage capacitor 16 are both charged to two hundred volts. Because initially the boost storage capacitor voltage and the energy storage capacitor voltage are essentially equal, capacitor switching diode 18 assumes a reverse biased or open circuit condition and operates to couple capacitors 14 and 16 in series to apply four hundred volts across the anode and cathode terminals of lamp 20. Upon operation of trigger means 22 to apply a trigger voltage to lamp 20, series coupled capacitors 14 and 16 begin discharging through lamp 20 to provide second stage ionization of the lamp. Because of its smaller relative storage capacity, the voltage on boost storage capacitor 14 rapidly decreases to about zero volts, a level well below the energy storage capacitor voltage which forward biases switching diode 18 and directly couples energy storage capacitor 16 across lamp 20.

Figure 9:
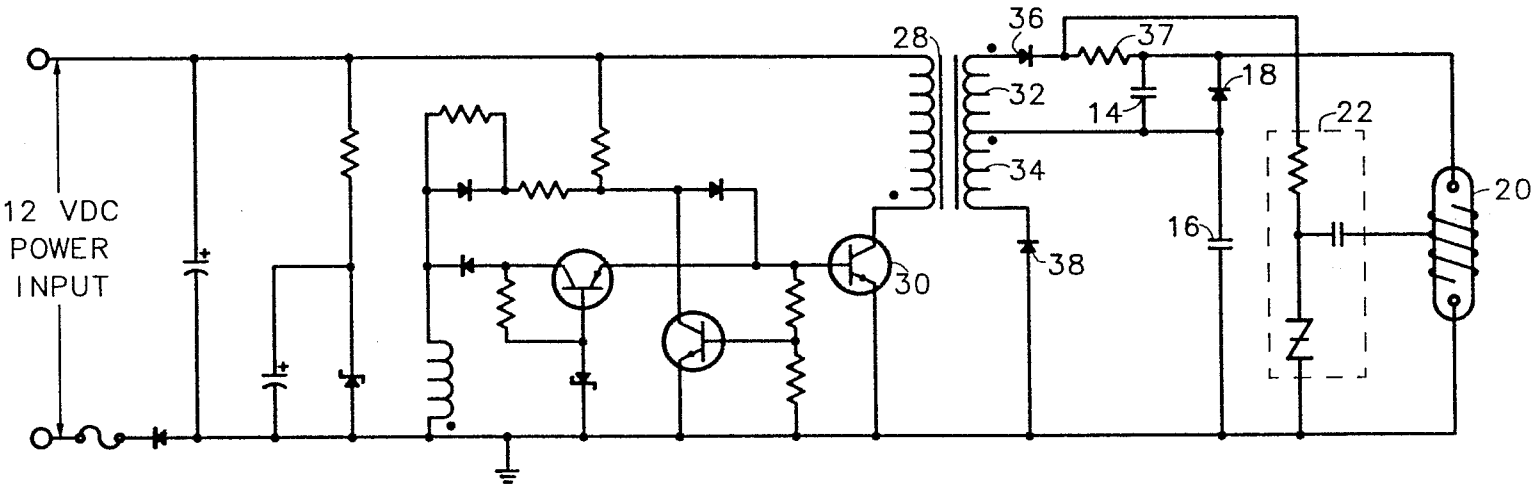
FIG. 9 illustrates a DC powered embodiment of the present invention utilizing a different configuration for the voltage controlled capacitor switching means of the present invention.

The FIG. 9 embodiment of the present invention is particularly adaptable to strobe power supplies which generate a double flash output. After completion of a double flash output, a nearly zero volt charge is left on boost storage capacitor 14 while a voltage nearly equal to the minimum holding voltage is left on energy storage capacitor 16. By increasing the turns ratio of winding section 32 to winding section 34 so that winding section 32 is producing the maximum desired boost voltage when winding section 34 is producing the minimum holding voltage, the FIG. 9 circuit can fully recharge boost storage capacitor 14 in a few power supply oscillations before a significant amount of charge is transferred to energy storage capacitor 16. Since boost storage capacitor 14 is fully recharged almost instantaneously, nearly the entire one tenth second time interval between the primary and secondary flashes is available to recharge energy storage capacitor 16 to a level well above the minimum holding voltage of lamp 20.

When capacitor switching means 18 reconfigures capacitors 14 and 16 in series, a voltage well above the minimum holding voltage is coupled directly across lamp 20. Trigger voltage generator 22 can now supply a trigger pulse to lamp 20 and initiate the secondary flash even though energy storage capacitor 16 has not been recharged to a voltage above the minimum anode voltage. This not only eliminates the energy storage capacitor recharge problems discussed above, but also increases the reliability and longevity of lamp 20 in double flash applications.

The voltage controlled capacitor switching means 18 of the present invention could also take the form of a micro processor-controlled switching system to reconfigure the boost storage capacitor and the energy storage capacitor in a variety of alternative configurations other than those specifically described and depicted above. Table 1 below illustrates the four possible configurations using a single boost storage capacitor and a single energy storage capacitor.

TABLE 1

CAPACITOR SWITCHING MEANS CONFIGURATIONS

| SWITCHING MEANS | 1 | 2 | 3 | 4 |
|---|---|---|---|---|
| First State | B + E | B + E | B | B |
| Second State | E | B \|\| E | E | B \|\| E |

Note:
+ = series connector
|| = parallel connector

The first Table 1 configuration where the boost and energy storage capacitors are coupled in series across the lamp in the first state and then the energy storage capacitor by itself is coupled directly across lamp 20 in the second state has been described above in connection with the FIG. 9 embodiment. The fourth Table 1 configuration of capacitor switching means 18 where the boost storage capacitor is coupled directly across the lamp in the first state while the energy storage capacitor and boost storage capacitor are coupled directly across the lamp in the second state have been illustrated in FIGS. 4, 7 and 8 above.

In another embodiment of the invention not specifically illustrated in the drawing figures, capacitor switching means 18 could be configured such that the boost and energy storage capacitors are coupled in series in the first state and are then switched into a parallel configuration in the second state. In this alternative embodiment of the invention, the capacitance rating of the boost and energy storage capacitors could be identical and both capacitors could take the form of aluminum electrolytic capacitors. The voltage rating of each electrolytic capacitor would be equal to half the voltage rating of a single prior art energy storage capacitor having the same total capacitance rating, but the ESR-induced power dissipation of each lower voltage boost and energy storage capacitor would be substantially lower than a the ESR-induced power dissipation of a comparable single aluminum electrolytic capacitor operated at twice the voltage.

In the third configuration recited in Table 1, the boost storage capacitor is coupled directly across the lamp in the first state while in the second state only the energy storage capacitor is coupled in parallel across the lamp.

For embodiments of the invention having boost storage capacitors significantly larger than one microfarad but substantially smaller than the capacitance of the energy storage capacitor, it may be advantageous to also couple the boost storage capacitor across the lamp in the second state to discharge the additional energy stored in the boost storage capacitor.

In each of the four configurations of capacitor switching means 18 illustrated in Table 1, a circuit designer is enabled to use aluminum electrolytic capacitors of substantially lower voltage ratings resulting in substantially reduced ESR-induced heat dissipation than is the case with the prior art strobe power supplies of the type illustrated in FIG. 1 which utilize only a single, high voltage aluminum electrolytic capacitor having high ESR-induced heat dissipation resulting in high capacitor operating temperatures and short capacitor MTBF ratings.

For general applications, it is desirable to select a boost capacitor having an ESR of about 0.05 Ohms or lower and an energy storage capacitor having an ESR of about 0.1 Ohms or lower.

It will be readily apparent to those skilled in the art that the use of two or more switched energy storage capacitors in a gaseous discharge lamp power supply may be modified in numerous ways and may assume many embodiments other than the preferred forms specifically set out and described above. For example, in certain embodiments of the invention, power supply means 10 may storage capacitor 16 rather than directing a substantially higher voltage to the boost capacitor 14. A large variety of different circuit designs will produce the desired objectives stated above for the voltage controlled capacitor switching means 18. A more sophisticated version of this circuit in combination with additional capacitors besides a single boost storage capacitor and a single energy storage capacitor could be switched into a variety of different configurations to achieve the objectives of the present invention of (1) applying a trigger voltage to achieve first stage lamp ionization; (2) applying a second voltage above the minimum anode voltage to achieve second stage lamp ionization; and (3) applying a third voltage below the minimum anode voltage but above the minimum holding voltage to discharge additional energy stored in a capacitor through the lamp. The sequential application of these three voltages of decreasing magnitude permits the use of switched energy storage capacitors to minimize the ESR-induced power losses as well as capacitor operating temperatures to substantially increase the power supply MTBF. Accordingly, it is intended by the appended claims to cover all such modifications of the invention which fall within the broad scope of the switched energy storage capacitor invention described above.

I claim:

1. Apparatus for flashing a gaseous discharge lamp having a gaseous interior, anode and cathode terminals, a trigger electrode, a minimum anode voltage and a minimum holding voltage, comprising:

a. trigger means for applying a series of spaced apart trigger voltage pulses to said trigger electrode where each trigger voltage pulse initiates first stage ionization of the gas in said lamp;

b. capacitor means including a boost storage capacitor rated to operate at a first voltage having a magnitude less than the magnitude of the trigger voltage pulses and an electrolytic energy storage capacitor rated to operate at a second voltage lower than the minimum anode voltage but higher than the minimum holding voltage for storing a defined quantum of energy, said energy storage capacitor having an equivalent series resistance substantially lower than the equivalent series resistance of a high voltage electrolytic capacitor rated to operate at a voltage above the minimum anode voltage and capable of storing the defined quantum of energy at an operating voltage above the minimum anode voltage, the capacitance rating of said energy storage capacitor substantially exceeding the capacitance rating of said high voltage capacitor and the capacitance rating of said boost storage capacitor;

c. a DC to DC converter power supply coupled to said capacitor means for charging said boost storage capacitor to the first voltage and for charging said energy storage capacitor to the second voltage, wherein the sum of the first and second voltages exceeds the minimum anode voltage, said power supply including i. a coupled inductor having a primary winding and a secondary winding;

ii. a switching transistor having collector and emitter terminals coupled in series with said primary winding for switching between conductive and non-conductive states to control the flow of current through said primary winding;

iii. said secondary winding of said coupled inductor including a first winding section coupled to direct a charging current into said boost storage capacitor when the voltage on said first winding section exceeds the voltage on said boost storage capacitor and a second winding section coupled to direct a charging current into said energy storage capacitor when the voltage on said second winding section exceeds the voltage on said energy storage capacitor, wherein said boost storage capacitor and said energy storage capacitor are recharged simultaneously during a part of each time interval between sequential trigger voltage pulses; and d. voltage controlled capacitor switching means having input terminals coupled across said boost storage capacitor and across said energy storage capacitor and output terminals coupled to the anode and cathode terminals of said lamp for operating in a first state to apply a boost voltage exceeding the minimum anode voltage to the anode and cathode terminals of said lamp to allow energy to flow into said lamp after the first stage ionization of the gas in said lamp has been achieved by said trigger means to initiate second stage ionization of the gas in said lamp and for switching into a second state after the boost voltage falls below the minimum anode voltage but before the boost voltage falls below the minimum holding voltage to couple said energy storage capacitor across the anode and cathode terminals of said lamp to enable said energy storage capacitor to discharge additional energy into said lamp;

whereby said energy storage capacitor dissipates substantially less heat in its equivalent series resistance and operates at a lower temperature than the high voltage, higher equivalent series resistance electrolytic capacitor.

2. Apparatus for flashing a gaseous discharge lamp having a gas interior, anode and cathode terminals, a minimum anode voltage and a minimum holding voltage, comprising:

a. trigger means coupled to said lamp for generating a trigger voltage pulse to provide first stage ionization of the gas in said lamp;

b. power supply means coupled to a boost storage capacitor and to an energy storage capacitor for charging said boost storage capacitor to a first voltage and for charging said energy storage capacitor to a second voltage, wherein the sum of the first and second voltages exceeds the minimum anode voltage of said lamp and the second voltage exceeds the minimum holding voltage of said lamp; and c. voltage controlled capacitor switching means having input terminals coupled across said boost storage capacitor and across said energy storage capacitor and further including output terminals coupled to the anode and cathode terminals of said lamp for operating in a first state to couple said boost storage capacitor in series with said energy storage capacitor and to apply the sum of the first and second voltages to the anode and cathode terminals of said lamp to allow energy to flow from said boost storage capacitor and said energy storage capacitor into said lamp after the first stage ionization of the gas in said lamp has been achieved by said trigger means to initiate second stage ionization of the gas in said lamp and for operating in a second state to couple said energy storage capacitor to the anode and cathode terminals of said lamp before the sum of the first and second voltages falls below the minimum holding of said lamp to enable said energy storage capacitor to continue discharging energy into said lamp.

3. The apparatus of claim 2 wherein the first voltage exceeds the minimum abode voltage of said lamp.

4. The apparatus of claim 3 wherein the second voltage is less than the minimum anode of said lamp.

5. The apparatus of claim 2 wherein the capacitance of the energy storage capacitor is substantially greater than the capacitance of the boost storage capacitor.

6. The apparatus of claim 5 wherein the capacitance of said boost storage capacitor is equal to or less than about one microfarad and the capacitance of said energy storage capacitor is equal to or greater than about fifty microfarads.

7. The apparatus of claim 5 wherein the equivalent series resistance of said boost storage capacitor is substantially lower than the equivalent series resistance of said energy storage capacitor.

8. The apparatus of claim 7 wherein the equivalent series resistance of said boost storage capacitor is less than about 0.05 Ohms and the equivalent series resistance of said energy storage capacitor is less than 0.1 Ohms.

9. The apparatus of claim 2 wherein said power supply means includes:

a. a coupled inductor having a primary winding and a secondary winding;

b. a switching transistor having collector and emitter terminals coupled in series with said primary winding for switching between conductive and nonconductive states to control the flow of current through said primary winding; and c. said secondary winding of said coupled inductor including a first winding section coupled across said boost storage capacitor and a second winding section coupled across said energy storage capacitor.

10. The apparatus of claim 9 wherein the number of turns of said first winding section is substantially greater than the number of turns of said second winding section for applying a higher voltage to said boost storage capacitor than to said energy storage capacitor.

11. The apparatus of claim 10 wherein said power supply means further includes:

a. first rectifier means coupled in series with said first winding section of said coupled inductor for charging said boost storage capacitor; and b. second rectifier means coupled in series with said second winding section of said coupled inductor for charging said energy storage capacitor.

12. The apparatus of claim 11 wherein said first and second rectifier means include half wave rectifiers.

13. The apparatus of claim 12 wherein said half wave rectifiers include diode rectifiers.

14. The apparatus of claim 11 wherein said boost storage capacitor includes a positive terminal coupled to the anode of said lamp and a negative terminal, wherein said energy storage capacitor includes a positive terminal coupled to the negative terminal of said boost storage capacitor and a negative terminal coupled to the cathode of said lamp.

15. The apparatus of claim 14 wherein voltage controlled capacitor switching means is coupled in parallel with said boost storage capacitor and in series with said energy storage capacitor.

16. The apparatus of claim 15 wherein voltage controlled capacitor switching means operates in a substantially open circuit configuration while said power supply means operates in the first state and operates in a substantially short circuit configuration while said power supply means operates in the second state.

17. The apparatus of claim 16 wherein said voltage controlled capacitor switching means includes a diode.

18. The apparatus of claim 17 wherein said diode switches in to a conductive state when the voltage on said boost storage capacitor drops to about zero volts.

19. The apparatus of claim 5 wherein said energy storage capacitor comprises an electrolytic capacitor.

20. The apparatus of claim 19 wherein said boost storage capacitor comprises a metal film capacitor.

21. A method for flashing a gas discharge lamp having a gas interior, anode and cathode terminals, a trigger electrode, a minimum anode voltage and a minimum holding voltage, comprising:

a. providing a trigger voltage source coupled to said trigger electrode to accomplish first stage ionization of the gas in said lamp;

b. providing a boost storage capacitor and an electrolytic energy storage capacitor, wherein the capacitance rating of said energy storage capacitor is substantially greater than the capacitance rating of said boost storage capacitor;

c. charging said boost storage capacitor to a first voltage;

d. charging said energy storage capacitor to a second voltage having a magnitude greater than the minimum holding voltage but less than minimum anode voltage, wherein the sum of the first and second voltages exceeds the minimum anode voltage of said lamp;

e. operating said trigger voltage source to initiate first stage ionization of the gas in said lamp;

f. configuring said boost storage capacitor and said energy storage capacitor into a series-connected first state to apply a boost voltage having a magnitude greater than the minimum anode voltage across the anode and cathode terminals of said lamp to allow energy to flow into said lamp after initiation of first stage ionization of the gas in said lamp to initiate second stage ionization of said lamp; and g. configuring said boost storage capacitor and said energy storage capacitor into a second state after the boost voltage falls below the minimum anode voltage but before the boost voltage falls below the minimum holding voltage to couple said energy storage capacitor across the anode and cathode terminals of said lamp to enable said energy storage capacitor to discharge additional energy into said lamp.

22. The method of claim 21 including the further step of decoupling said boost storage capacitor from said lamp during the second state.

23. The method of claim 21 wherein said boost storage capacitor is coupled in parallel with said energy storage capacitor during the second state.

24. The method of claim 21 wherein the capacitance rating of said boost storage capacitor is less than 1/50th of the capacitance rating of said energy storage capacitor.

25. The method of claim 21 wherein the equivalent series resistance of said energy storage capacitor is substantially less than the equivalent series resistance of an electrolytic capacitor rated to operate at a voltage above the minimum anode voltage.

26. The method of claim 25 wherein said boost voltage capacitor is a non-electrolytic capacitor.

27. The method of claim 26 wherein said boost storage capacitor is a metal film capacitor.

28. Apparatus for flashing a gaseous discharge lamp having a gas interior, anode and cathode terminals, a trigger electrode, a minimum anode voltage and a minimum holding voltage, comprising:

a. trigger means coupled to the trigger electrode of said lamp for generating a series of trigger pulses separated by defined time intervals to initiate first stage ionization of the gas in said lamp;

b. a two element power supply including i. a boost power supply continuously coupled to a boost storage capacitor for applying a first voltage to said boost storage capacitor and for directing a charging current into said boost storage capacitor whenever the first voltage exceeds the voltage on said boost storage capacitor;

ii. an energy storage power supply continuously coupled to an electrolytic energy storage capacitor for applying a second voltage having a level above the minimum holding voltage but below the minimum anode voltage to said energy storage capacitor, for directing a charging current to said energy storage capacitor whenever the second voltage exceeds the voltage on said energy storage capacitor, and for causing said energy storage capacitor to store a defined quantum of energy, said energy storage capacitor having an equivalent series resistance substantially lower than the equivalent series resistance of a high voltage electrolytic capacitor rated to operate at a voltage above the minimum anode voltage and capable of storing the defined quantum of energy at an operating voltage above the minimum anode voltage, the capacitance rating of said energy storage capacitor substantially exceeding the capacitance rating of said high voltage capacitor, wherein the sum of the first and second voltages exceeds the minimum anode voltage, wherein the capacitance rating of said energy storage capacitor is substantially greater than the capacitance rating of the boost storage capacitor and wherein said boost storage capacitor and said energy storage capacitor are recharged simultaneously during a part of each time interval between sequential trigger voltage pulses; and c. voltage controlled capacitor switching means having input terminals coupled across said boost storage capacitor and across said energy storage capacitor and output terminals coupled to the anode and cathode terminals of said lamp for operating in a first state to apply a boost voltage exceeding the minimum anode voltage across the anode an cathode terminals of said lamp to allow energy to flow from said boost storage capacitor into said lamp after first stage ionization of the gas in said lamp has been achieved by said trigger means to initiate second stage ionization of the gas in said lamp and for switching into a second state after the boost voltage falls below the minimum anode voltage but before the boost voltage falls below the minimum holding voltage to couple said energy storage capacitor across the anode and cathode terminals of said lamp to enable said energy storage capacitor to discharge energy into said lamp as the voltage on said energy storage capacitor decreases from the second voltage to the minimum holding voltage of said lamp;

whereby said energy storage capacitor dissipates substantially less heat in its equivalent series resistance and operates at a lower temperature than the high voltage, higher equivalent series resistance electrolytic capacitor.

29. The apparatus of claim 28 wherein said boost storage capacitor is fully charged to the first voltage and said energy storage capacitor is fully charged to the second voltage after each trigger pulse and before the generation of a subsequent trigger pulse.

30. The apparatus of claim 28 wherein said voltage controlled capacitor switching means couples said boost storage capacitor and said energy storage capacitor in series while operating in the first state.

31. The apparatus of claim 28 wherein the capacitance rating of said boost storage capacitor is equal to or less than about one microfarad and the capacitance rating of said energy storage capacitor is equal to or greater than about fifty microfarads.

32. The apparatus of claim 28 wherein said power supply includes:

a. a coupled inductor including a primary winding and a secondary winding;

b. a switching transistor having collector and emitter terminals coupled in series with said primary winding for switching between conductive and nonconductive states to control the flow of current through said primary winding; and c. said secondary winding of said coupled inductor including a first winding section coupled across said boost storage capacitor and a second winding section coupled across said energy storage means.

33. The apparatus of claim 32 wherein the number of turns of said first winding section is substantially greater than the number of turns of said second winding section for applying a higher voltage to said boost storage capacitor than to said energy storage capacitor.

34. The apparatus of claim 33 wherein said power supply further includes:

a. first rectifier means coupled in series with said first winding section of said coupled inductor for charging said boost storage capacitor; and b. second rectifier means coupled in series with said second winding section of said coupled inductor for charging said energy storage means.

35. The apparatus of claim 34 wherein said first and second rectifier means include half wave rectifiers.

36. The apparatus of claim 35 wherein said half wave rectifiers include diode rectifiers.

37. The apparatus of claim 32 wherein said boost storage capacitor includes positive and negative terminals, wherein said energy storage capacitor includes positive and negative terminals and wherein said voltage controlled capacitor switching means includes:

a. first diode mans coupled in series between the positive terminal of said boost storage capacitor and the anode terminal of said lamp and b. second diode means coupled between the positive terminal of said energy storage means and the anode terminal of said lamp;

wherein current flows out of said boost storage capacitor through said first diode means when said voltage controlled capacitor switching means operates in the first state and current flows from said energy storage capacitor through said second diode means when said voltage controlled capacitor switching means operates in the second state.

38. The apparatus of claim 37 wherein said first diode means includes a first diode and wherein said second diode means includes a second diode.

39. The apparatus of claim 28 wherein said boost storage capacitor includes a metal film capacitor.

40. The apparatus of claim 28 wherein said trigger means generates spaced apart group of trigger pulses, wherein each group of pulses includes a primary trigger pulse and a secondary trigger pulse, wherein the primary and secondary trigger pulses are separated by a first time interval and each group of trigger pulses is separated by a second time interval, and wherein the duration of the first time interval is substantially shorter than the duration of the second time interval.

41. The apparatus of claim 40 wherein the capacitance rating of said boost storage capacitor is set at an adequately low value and the duration of the first time interval between the primary and secondary trigger pulses is set at an adequately high value such that said boost storage capacitor is charged to a voltage substantially equal to the first voltage during the first time interval.

42. The apparatus of claim 41 wherein the capacitance rating of said energy storage capacitor is set at an adequately high value and the duration of the first time interval is set at an adequately low value such that said energy storage capacitor is charged to a voltage above the minimum holding but below the second voltage during the first time interval.

43. The apparatus of claim 42 wherein the second time interval between groups of trigger pulses is set at an adequately high value such that said energy storage capacitor is fully charged to the first voltage during the second time interval.

44. The apparatus of claim 43 wherein each primary trigger pulse initiates a full power flash from said lamp and each secondary trigger pulse initiates a reduced power flash from said lamp closely spaced in time relative to the full power flash.

45. The apparatus of claim 28 wherein said boost power supply recharges said boost storage capacitor to the first voltage and wherein said energy storage power supply recharges said energy storage capacitor to the second voltage during each of said defined time intervals between trigger pulses.

46. Apparatus for flashing a gaseous discharge lamp having gas interior, anode and cathode terminals, a minimum anode voltage and a minimum holding voltage, comprising:

a. trigger means coupled to said lamp for generating spaced apart groups of trigger pulses, wherein each trigger pulse initiates first stage ionization of the gas in said lamp, wherein each group of pulses includes a primary trigger pulse and a secondary trigger pulse, wherein the primary and secondary trigger pulses are separated by a first time interval and each group of trigger pulses is separated by a second time interval, and wherein the duration of the first time interval is substantially shorter than the duration of the second time interval;

b. capacitor means including a boost storage capacitor and an energy storage capacitor;

c. power supply means coupled to said capacitor means for charging said boost storage capacitor to a first voltage having a magnitude less than the trigger voltage pulse magnitude and for charging said energy storage capacitor to a second voltage having a magnitude greater than the minimum holding voltage but less than the minimum anode voltage, wherein the sum of the first and second voltages exceeds the minimum anode voltage;

d. voltage controlled capacitor switching means having input terminals coupled across said boost storage capacitor and across said energy storage capacitor and output terminals coupled to the anode and cathode terminals of said lamp for operating in a first state to apply a boost voltage exceeding the minimum anode voltage to the anode and cathode terminals of said lamp to allow energy to flow into said lamp after first stage ionization of the gas in said lamp to initiate second stage ionization of the gas in said lamp and for switching into a second state after the boost voltage falls below the minimum anode voltage but before the boost voltage falls below the minimum holding voltage to couple said energy storage capacitor across the anode and cathode terminals of said lamp to enable said energy storage capacitor to discharge additional energy into said lamp; and e. the capacitance rating of said boost storage capacitor being set at an adequately low value and the duration of the first time interval between the primary and secondary trigger pulses being set at an adequately high value such that said boost storage capacitor is charged to a voltage substantially equal to the first voltage during the first time interval and the capacitance rating of said energy storage capacitor being set at an adequately high value and the duration of the first time interval being set at an adequately low value such that said energy storage capacitor is charged to a voltage above the minimum holding voltage but below the second voltage during the first time interval and the second time interval between groups of trigger pulses being set at an adequately high value such that said energy storage capacitor is fully charged to the first voltage during the second time interval;

whereby each primary trigger pulse initiates a full power flash from said lamp and each secondary trigger pulse initiates a reduced power flash from said lamp closely spaced in time relative to the full power flash.

47. The apparatus of claim 46 wherein the first time interval has a duration less than or equal to about one tenth of a second.

48. The apparatus of claim 47 wherein the duration of the second time interval is substantially greater than one tenth of a second.

49. The apparatus of claim 46 wherein said voltage controlled capacitor switching means couples said boost storage capacitor in series with said energy storage capacitor while operating in the first state to apply the sum of the first and second voltages to the anode and cathode terminals of said lamp to allow energy to flow from both said boost storage capacitor and said energy storage capacitor through said lamp after first stage ionization of the gas in said lamp by said trigger means.

50. The apparatus of claim 49 wherein the first voltage exceeds the minimum anode voltage of said lamp.

51. The apparatus of claim 50 wherein the second voltage is less than the minimum anode voltage of said lamp.

52. The apparatus of claim 51 wherein the capacitance rating of said energy storage capacitor is substantially greater than the capacitance rating of said boost storage capacitor.

53. The apparatus of claim 52 wherein the capacitance rating of said boost storage capacitor is equal to or less than about one microfarad and the capacitance rating of said energy storage capacitor is equal to or greater than about fifty microfarads.

54. The apparatus of claim 53 wherein the equivalent series resistance of said boost storage capacitor is substantially lower than the equivalent series resistance of said energy storage capacitor.

55. The apparatus of claim 54 wherein the equivalent series resistance of said boost storage capacitor is less than about 0.05 Ohms and the equivalent series resistance of said energy storage capacitor is less than about 0.1 Ohms.

56. The apparatus of claim 46 wherein said power supply means includes:

a. a coupled inductor having a primary winding and a secondary winding;

b. a switching transistor having collector and emitter terminals coupled in series with said primary winding for switching between conductive and nonconductive states to control the flow of current through said primary winding; and c. said secondary winding of said coupled inductor including a first winding section coupled across said boost storage capacitor and a second winding section coupled across said energy storage capacitor.

57. The apparatus of claim 56 wherein the number of turns of said first winding section is substantially greater than the number of turns of said second winding section for applying a higher voltage to said boost storage capacitor than to said energy storage capacitor.

* * * * *